US006098562A

United States Patent [19]

Förthmann

[11] Patent Number: 6,098,562

[45] Date of Patent: Aug. 8, 2000

[54] MOUNTING DEVICE FOR MOUNTING A SELF-STEERING SYSTEM ON THE STERN OF A BOAT

[76] Inventor: Peter Förthmann, Bandwirkerstrasse 39-41, D-22041 Hamburg, Germany

[21] Appl. No.: 09/136,711

[22] Filed: Aug. 19, 1998

[30] Foreign Application Priority Data

Aug. 22, 1997 [DE] Germany ..... 297 15 013 U

[51] Int. Cl.[7] ..... B63H 25/06

[52] U.S. Cl. ..... 114/144 R; 114/144 C

[58] Field of Search ..... 114/144 R, 144 C, 114/165; 248/640, 641, 642, 643, 298.1, 292.14, 287.1, 274.1, 276.1

[56] References Cited

U.S. PATENT DOCUMENTS

| | | | |
|---|---|---|---|
| 2,939,658 | 6/1960 | Roemer . | |
| 4,327,657 | 5/1982 | Knoos | 114/144 C |
| 4,766,833 | 8/1988 | Knoos | 114/144 C |
| 5,309,858 | 5/1994 | Knoos | 114/144 C |

*Primary Examiner*—Sherman Basinger

*Attorney, Agent, or Firm*—Tarolli, Sundheim, Covell, Tummino & Szabo L.L.P.

[57] ABSTRACT

A mounting device for mounting a self-steering system on the stern (40) of a boat at a predefined angle determined from the stern configuration and a desired inclination of the self-steering system, comprises a supporting structure (10) for retaining and connecting the self-steering system with a pair of mounting brackets (20A, 20B) for retaining and connecting the supporting structure (10) with the stern of a boat (40), in which the mounting brackets (20A, 20B) have two first elongated holes (21, 22) extending along at least one approximately circular line for clamping the supporting structure (10) fast with at least four threaded bolts or the like such that its angle can be adjusted. In order to reduce the number of components specially tailored for actual sterns and for the desired installation position to least two first elongated holes (31, 32) extending essentially transverse to the long direction (L) of the plate-like adaptor piece and "congruent" with the elongated holes (21, 22) of the connecting bracket and, in a second longitudinal area (39), at least two second elongated holes (42A, 42B) extending essentially in the long direction (L) and arranged essentially parallel with each other.

4 Claims, 7 Drawing Sheets

30A
L
38
32
33
31
42A
39
21
23
22
42B
20A
41

31
33
32
L
38
30B
42B
39
42A
22
23
20A
21
41

MOUNTING DEVICE FOR MOUNTING A SELF-STEERING SYSTEM ON THE STERN OF A BOAT

The present invention relates to a mounting device for mounting a self-steering system on the stern of a boat at a predefined angle determined from the stern configuration of the boat and a desired inclination of the self-steering system having the features of the precharacterizing clause of claim 1.

Self-steering systems for boats, especially sailing boats, are mounted on the stern of the boat if the self-steering system is a hydrodynamic system, that is to say one in which any necessary corrections to the boat's course are effected automatically (auxiliary rudder) or initiated (servo-pendulum rudder) by at least one auxiliary or servo-pendulum rudder that can be adjusted about a horizontal or a vertical axis. It is necessary with a self-steering system of this type to mount the auxiliary or servo-pendulum rudder on the stern of the boat in a position that provides optimal (i.e. minimum interference) hydrodynamic conditions for the rudder blade and allows the operator to engage, disengage and adjust the desired course of the system from the deck of the boat and with maximum safety. Consequently, the auxiliary or servo-pendulum rudder must as a rule be mounted relatively close to the aft end of the boat.

Owing to the extraordinary variety of stern configurations, especially for sailing boats, the latter being the principal area of application for hydrodynamic self-steering systems, the requirements for the arrangement of the system mentioned above can frequently only be met with custom-made mounting devices. At least one, normally two or more, of the mounting device components is/are individually tailored to fit each different stern configuration. This may sometimes be necessary even for boats of the same design if additional accessories such as bathing ladders and the like have been added to particular boats or if the owner requests a different solution. Variable installation brackets of the generic type are known and do eliminate the need for custom mounting components in a number of simple installation situations. Normally, however, it is necessary to provide at least one levelling component in the form of a wooden spacer that follows the horizontal curvature of the stern. In fact the generic variable mounting devices are only able to level stern configurations whose deviation from the vertical falls within the range between +15 and −15. Viewed from above, i.e. in the horizontal direction, both traditional sailing boat sterns, such as sharp sterns or canoe sterns, and modern stern designs are raked and/or curved, i.e. not planar.

The object of the invention is to reduce to a minimum the number of components of generic mounting devices specially tailored for actual sterns and for the desired installation position of the self-steering system and as far as possible to remove the need for such tailored parts, means for levelling out the curvature of the stern, such as the spacer mentioned, still being used if necessary. This object is achieved with a mounting device having the features of claim 1. The adaptor pieces of the invention, which have at least four elongated holes, provide astonishing variability in that they considerably extend the range of possible angles of inclination and distances between the self-steering system and the stern of the boat. Mounting devices according to the invention appear particularly elegant if the adaptor pieces are manufactured in a few basic forms. This not only extends the feasible range of distances and angles but also allows the most aesthetically pleasing arrangement without requiring excessively large stocks of different adaptor pieces to be held.

The angular range over which the adaptor piece can be mounted on the adaptor bracket on the stern of the boat can be extended by arranging at least some of the elongated holes, which run parallel to each other, in one longitudinal zone of the plate-like adaptor piece such that, viewed in the long direction of the latter, they are offset with respect to one another or can be used in a manner offset with respect to each other. In particular this makes it possible to invert the arrangement for use with a negatively raked stern or a positively raked stern.

It is also possible to configure the mounting device such that a plate-like adaptor piece of this type can be used not only in the essentially horizontal position but also in the essentially vertical position. This is done by providing additional curved elongated holes in the zone of the adaptor piece that bears the first curved elongated holes, in particular such that pairs of elongated holes are provided in mirror or rotational symmetry with each other, preferably in 90 symmetry and along the circumference of a single circle. These arrangement options are advantageous if the mounting brackets, which are mounted on the stern of the boat, and the self-steering system are to be separated not so much along the keel line of the boat, i.e. in the horizontal direction, but in the vertical direction, as can be required, for example, in the case of so-called spoiler sterns, in particular with horizontal or very gently raked stern areas.

The curved first elongated holes may be supplemented by a third elongated hole, arranged concentric to the two others, or by a central circular bore (claim 4), in order to simplify mounting and removal of the self-steering system on the supporting structure and adjustment of the inclination of the supporting structure. Hereby, at least one positioning bolt can be arranged horizontally to position the self-steering system on the supporting structure. This bolt does not normally help to fasten the supporting structure and the mounting bracket or plate-like adaptor piece but instead sits with some play in the associated elongated hole or bore and can thus move freely in its elongated hole or turn freely in its bore to accompany any adjustment in the angle of the supporting structure such that the positioning of the self-steering system on the supporting structure remains unchanged. Clearly the arrangement according to claim 4 has independent inventive significance, and can also beneficially be used in situations where there is no need for any additional horizontal or vertical separation between the self-steering system and the stern of the boat. Here, the supporting structure is fastened and adjusted with respect to its inclination directly on the mounting brackets and the plate-like adaptor piece can be omitted.

The exemplary embodiments and subclaims describe advantageous configurations of mounting devices according to the invention conceived especially to ensure a particularly great variety of installation options with the simplest possible manufacturing and machining requirements.

The components mentioned above, claimed and described in the exemplary embodiments that are to be used according to the invention are not subject to any particular special requirements with respect to their dimensions, shape, choice of materials and technical design, so the selection criteria known in the respective area of application may be applied without restriction.

Further details, features and advantages of the subject matter of the invention may be found in the following description of the appended drawing, in which, by way of example, preferred embodiments of the mounting adaptor pieces are shown and in which.

Figure 3C:
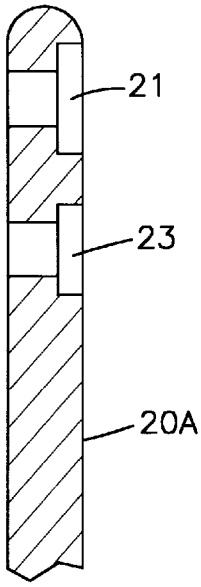
FIG. 3C shows the same mounting bracket in section along the line IIIC—IIIC in FIG. 3A.
Figure 3A:
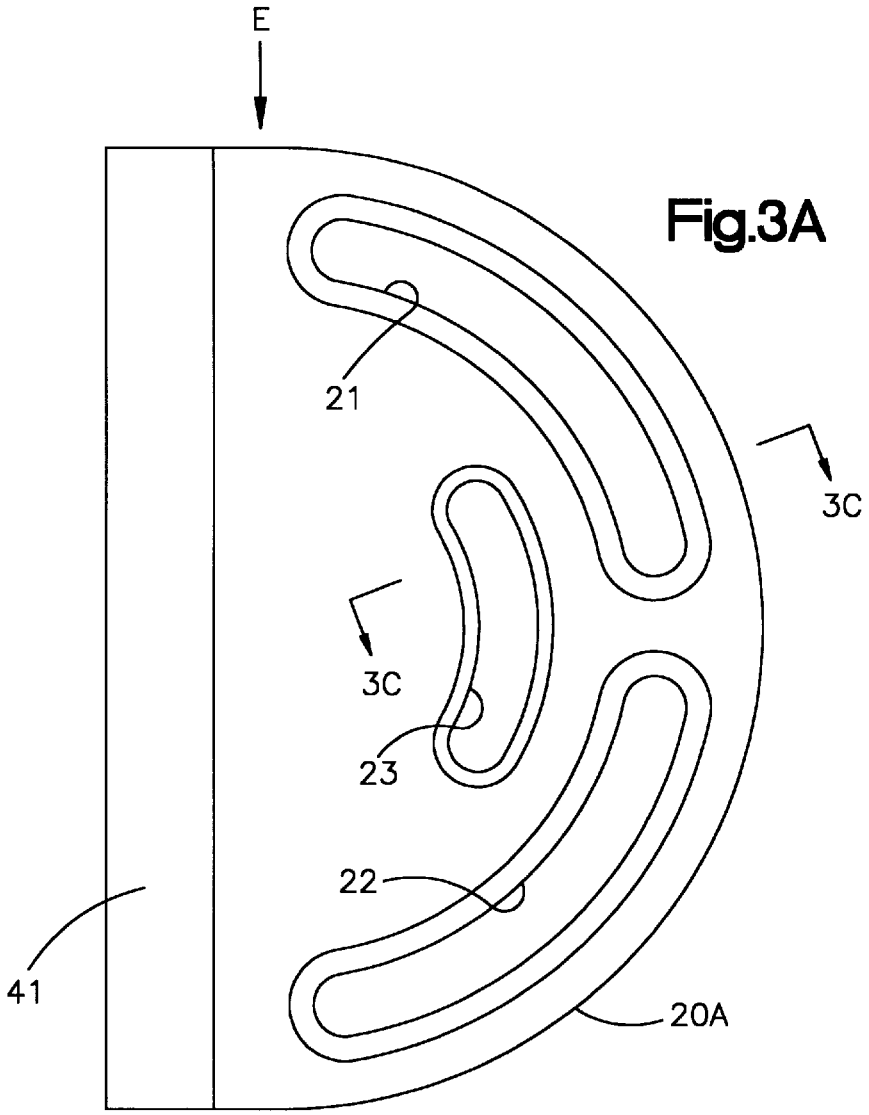
FIG. 3A shows a mounting bracket from a mounting device according to either of FIGS. 5A and 5B viewed from the right side or, as the case may be, from the left side (view D in FIG. 3B)
Figure 3B:
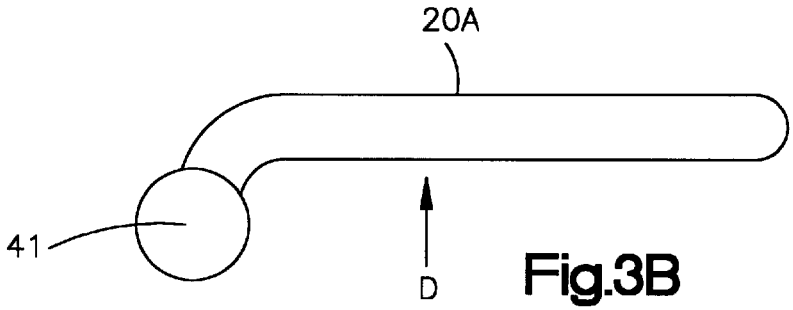
FIG. 3B shows the same mounting bracket viewed from above or, as the case may be, from below (view E in FIG. 3A)
Figure 4B:
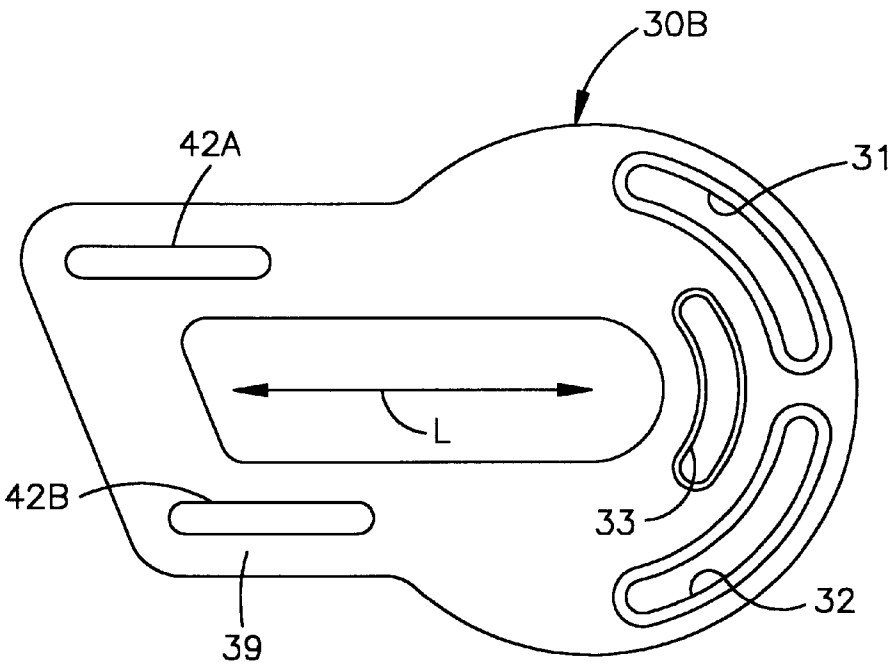
Figure 4A:
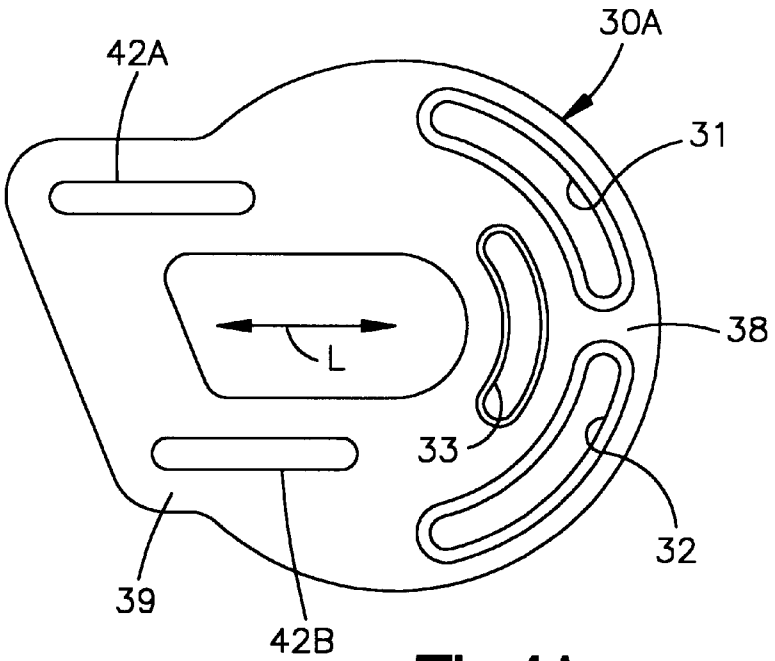
Figure 4C:
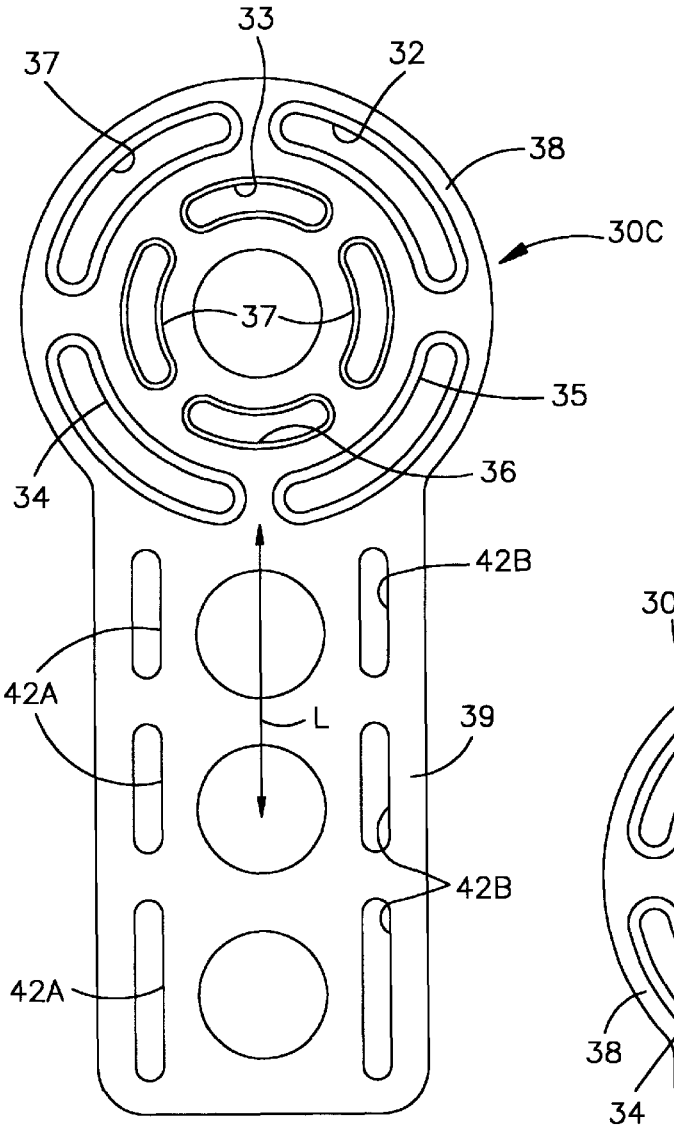
Figure 4D:
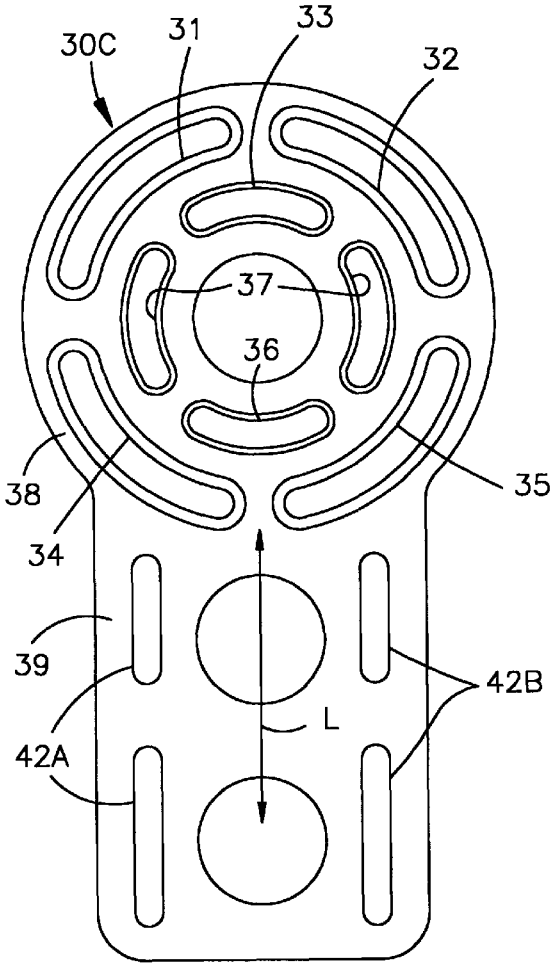
Figures 5A, 5B:
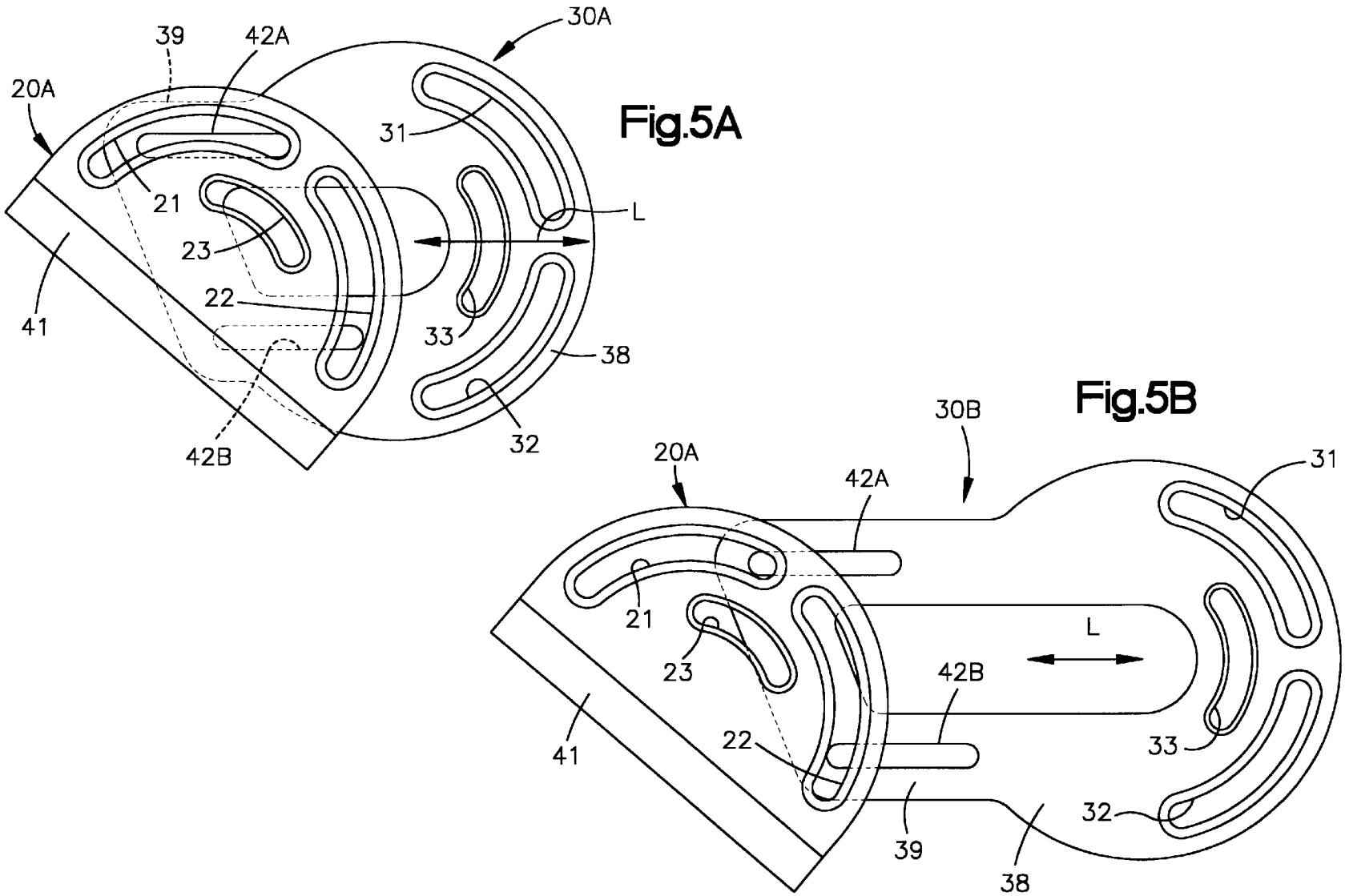
Figure 6:
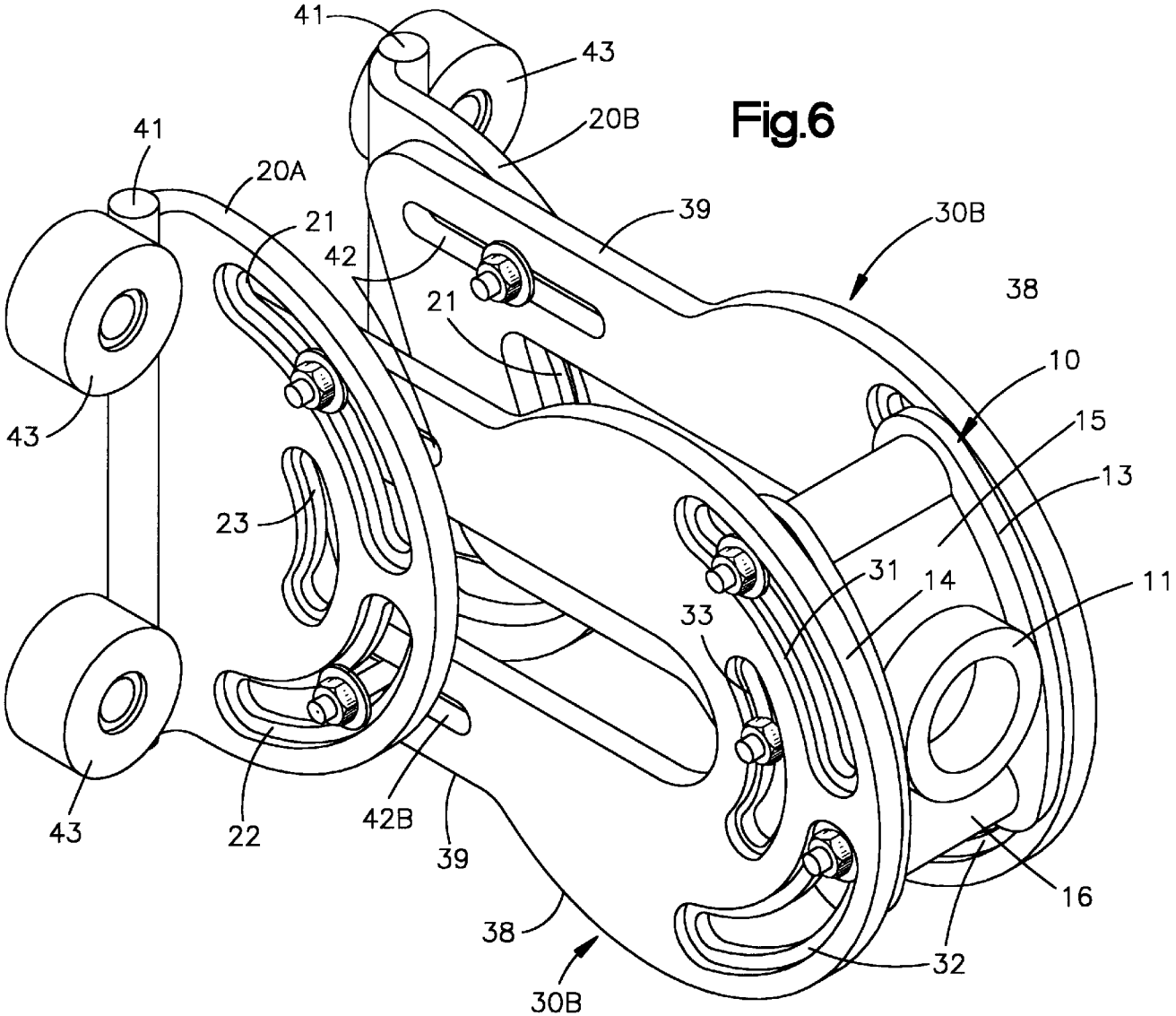

FIG. 4A—4D shows four different embodiments of a plate-like adaptor piece from a mounting device according to FIGS. 5A and 5B in side view;

FIG. 5A shows a mounting bracket (according to FIG. 3A) from a mounting device with a first plate-like adaptor piece (according to FIG. 4A) in a first installation position in side view;

FIG. 5B shows the mounting bracket (according to FIG. 3A) from a mounting device and a second embodiment of a plate-like adaptor piece (according to FIG. 4B) in a second installation position in side view; and FIG. 6 shows an entire mounting device in perspective view.

Figure 1A:
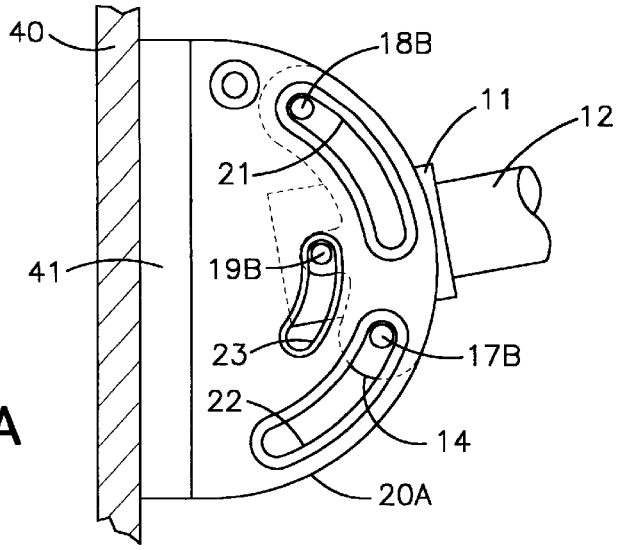
FIG. 1A shows a mounting device for mounting a self-steering system on the stern of a boat, without plate-like adaptor pieces, in side view.
Figure 1B:
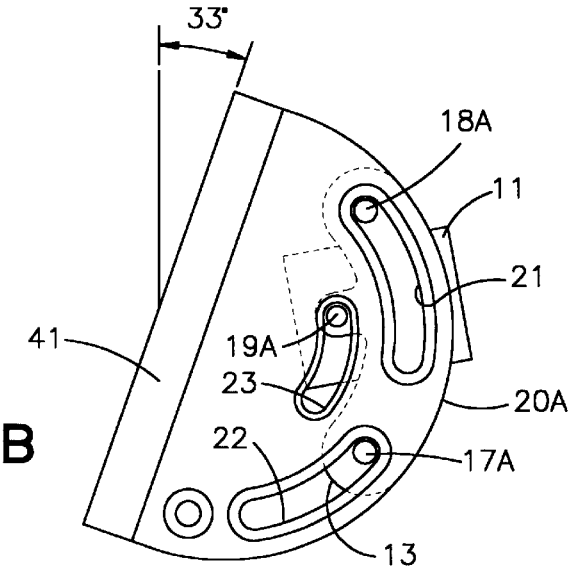
FIG. 1B shows the same mounting device in a second installation position.
Figure 1C:
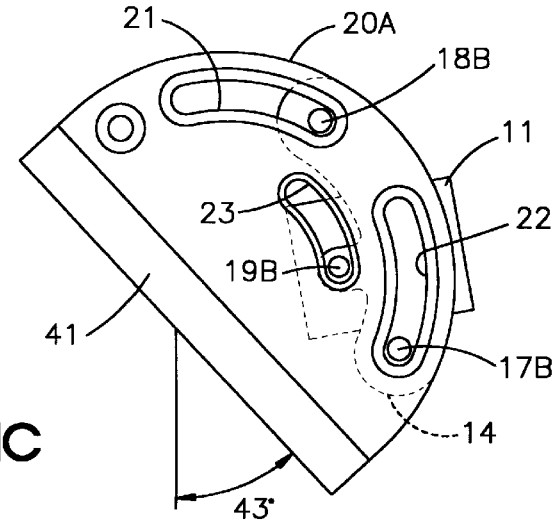
FIG. 1C shows the same mounting device in a third installation position.
Figure 2B:
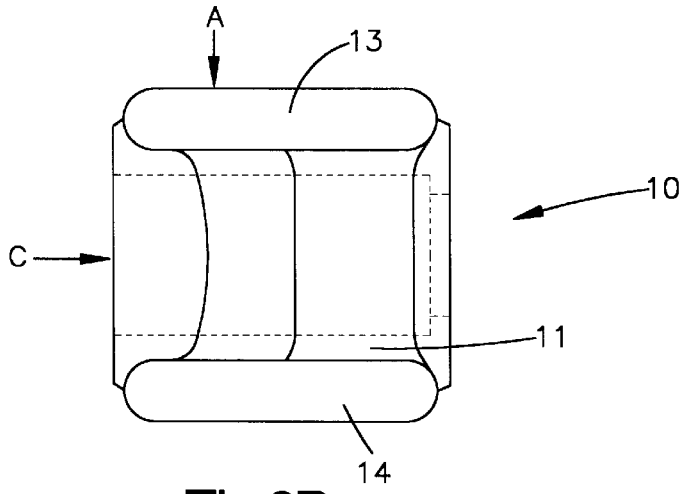
FIG. 2B shows the same supporting structure viewed from above or, as the case may be, from below (view B in FIGS. 2A and 2C)
Figure 2A:
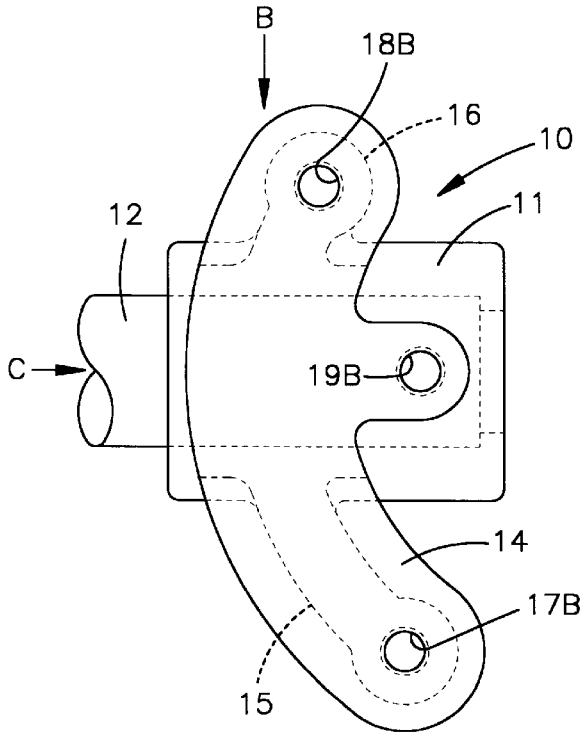
FIG. 2A shows the supporting structure for the self-steering system from a mounting device according to any of FIGS. 1 to 5 viewed from the right side or, as the case may be, from the left side (view A in FIGS. 2B and 2C)
Figure 2C:
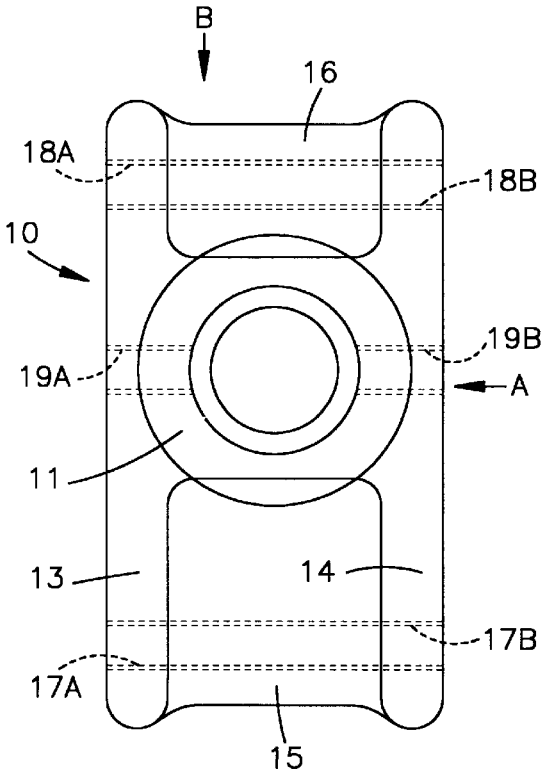
FIG. 2C shows the same supporting structure viewed from behind (view C in FIGS. 2A and 2B)

FIGS. 2A to 2C show a supporting structure 10 comprising a sleeve-like seat 11 for a cantilever shaft 12 of a self-steering system (not shown) and a pair of mounting brackets 13, 14, which are arranged parallel with each other, are formed integrally with the seat 11 and are integrally connected with each other outside the zone of contact with the seat 11 by webs 15, 16. The ends of the brackets are bored through approximately at right angles to the cantilever shaft 12 and at right angles to the bracket surface. A third bore also passes through the seat 11 in the central bracket area. The bores 17A, 17B, 18A, 18B, 19A and 19B, which are provided with an inside thread, come to lie flush in the assembled state either with elongated holes 21, 22 and 23 of a pair of mounting brackets 20A/20B (see FIGS. 1A to 1C and 3A) or with elongated holes 31 to 37 of a pair of adaptor pieces 30A to 30D (see FIGS. 5A to 6) such that fastening screws (not shown) contact the mounting brackets from one side in each case through the elongated holes and can be screwed into the inside thread of the bores 17A to 19B. Here the bores 17A to 18B are used for rigid connection to the mounting brackets and the bores 19A or 19B are used for fixing the cantilever shaft 12 in place within the seat 11. The cantilever shaft 12 has a suitable through bore for this purpose. The supporting structure 10 may be connected with adaptor pieces 30A, 30B, 30C or 30D in just the same way as with the mounting brackets 20A and 20B. This becomes clear from the following description of FIGS. 4A to 5B.

The adaptor pieces 30A to 30D according to FIGS. 4A to 4D are all of plate-like design, that is to say they consist essentially of a flat material or another material with parallel side faces and not particularly great thickness, for example a few millimeters, even as a cast component, and all have a first longitudinal area 38 and a second longitudinal area 39 respectively. In the exemplary embodiment shown and to this extent preferred, the respective first longitudinal areas 38 are somewhat wider than the second longitudinal areas 39 and have an oval to round basic shape that provides sufficient space to accommodate a number of curved elongated holes 31 to 37. All the elongated holes extend along approximately circular lines that are arranged approximately concentric with one another and are congruent with the elongated holes of the mounting brackets 13 and 14. In the embodiments according to FIGS. 4C and 4D, additional elongated holes of this type are provided in mirror or 90 rotational symmetry so that it is also possible for the adaptor piece to be used in approximately vertical or oblique arrangement and connected to the supporting structure according to FIGS. 2A to 2C, that is to say in analogy to the connection shown in FIGS. 1A to 1C between the mounting brackets and the supporting structure.

The second longitudinal area 39 of each adaptor piece, the sides of which area are approximately parallel, accommodates at least two second elongated holes 42A, 42B arranged essentially parallel with each other, which, unlike the curved elongated holes, extend essentially in the long direction L of the plate-like adaptor pieces 30A to 30D and are arranged offset with respect to each other in the long direction (FIGS. 4A and B) or allow the bolts used to be arranged offset with respect to each other.

As can be seen in detail in FIGS. 5A and 5B, for example, the second elongated holes 42A and 42B are both able to overlap with two first elongated holes 21, 22 of one of mounting brackets 20A and 20B respectively. This overlap is possible over the whole length of the elongated hole, thus providing an essentially uninterrupted range of adjustment for the distance between the mounting brackets and the supporting structure. The supporting structures, which are mounted in the respective first longitudinal areas 38 of the adaptor piece, have been omitted from FIGS. 5A and 5B in the interests of clarity. The mounting brackets 20A and 20B may be mounted on the stern 40 of a boat using whatever means 43 (FIG. 6) desired. In the exemplary embodiments shown and to this extent preferred, rail-like enlargements 41 extending along a bent leg of the mounting brackets are used for this purpose (FIG. 6).

Reference Numbers

10 supporting structure
11 seat
12 cantilever shaft
13 mounting bracket
14 mounting bracket
15 web
16 web
17A/B bore
18A/B bore
19A/B bore
20A/B pair of mounting brackets
21 elongated hole
22 elongated hole
23 elongated hole
30A–30D adaptor pieces
31 elongated hole
32 elongated hole
33 elongated hole
34 elongated hole
35 elongated hole

36 elongated hole

37 elongated hole

38 first longitudinal area

39 second longitudinal area

40 stern of the boat

41 enlargement

42A/B second elongated holes

43 mounting means

A view

B view

C view

D view

L long direction

What is claimed is:

1. Mounting device for mounting a self-steering system on the stern (40) of a boat at a predefined angle determined from the stern configuration and a desired inclination of the self-steering system, having a support structure (10) for retaining and connecting the self-steering system with a pair of mounting brackets (20A, 20B), for retaining and connecting the supporting structure (10) with the stern of a boat (40), in which the mounting brackets (20A, 20B) have two first elongated holes (21, 22) extending along at least one approximately circular line for clamping the supporting structure (10) fast with a plurality of fasteners such that the position of the supporting structure can be adjusted, characterized in that a pair of elongate, plate-like adaptor pieces (30A, 30B, 30C, 30D) is provided, said adaptor pieces each being suitable for releasable connection at one end with one of the mounting brackets (20A; 20B) and at the other end with the supporting structure (10) and for this purpose having, in a first longitudinal area (38), at least two first elongated holes (31, 32) extending essentially transverse to the long direction (L) of the plate-like adaptor piece and congruent with the elongated holes (21, 22) of the mounting brackets and, in a second longitudinal area (39), at least two second elongated holes (42A, 42B) extending essentially in the long direction (L) and arranged essentially parallel with each other.

2. Mounting device according to claim 1 characterized in that at least some of the second elongated holes (42A, 42B) run offset with respect to one another viewed in the long direction (L).

3. Mounting device according to either of claims 1 and 2, characterized in that at least two additional curved elongated holes (34, 35) are provided in the first longitudinal area (38) of the adaptor pieces (30C, 30D) that bears the first elongated holes (31, 32), said additional curved elongated holes being arranged in mirror or rotational symmetry with the first elongated holes (31, 32) of the adaptor pieces (30C, 30D).

4. Mounting device according to claims 1 and 2, characterized in that three pairs of bores (17A/B, 18A/B, 19A/B) in the supporting structure are provided in a mutually asymmetric arrangement.

* * * * *